US005745953A

United States Patent [19]

Golden

[11] Patent Number: 5,745,953

[45] Date of Patent: May 5, 1998

[54] HINGE ASSEMBLY, PLATFORM AND METHOD OF MAKING SAME

[75] Inventor: Michael D. Golden, Corona del Mar, Calif.

[73] Assignee: Western Design Corporation, Irvine, Calif.

[21] Appl. No.: 449,220

[22] Filed: May 24, 1995

[51] Int. Cl.[6] ..... E05D 7/10

[52] U.S. Cl. ..... 16/260

[58] Field of Search ..... 16/260, 254, 266, 16/271

[56] References Cited

U.S. PATENT DOCUMENTS

| | | | |
|---|---|---|---|
| 479,731 | 7/1892 | Bingham | 16/260 |
| 780,441 | 1/1905 | Von Oven | 16/254 |
| 2,484,581 | 10/1949 | Pallmen | 16/257 |
| 2,776,521 | 1/1957 | Zimmerman | 446/115 |
| 3,095,965 | 7/1963 | Stahl et al. | 206/228 |
| 3,130,651 | 4/1964 | Werner | 16/267 |
| 4,109,821 | 8/1978 | Lutz | 220/337 |
| 4,840,514 | 6/1989 | Defrance et al. | 16/260 |
| 5,070,577 | 12/1991 | Bonneville et al. | 16/260 |
| 5,101,536 | 4/1992 | Gabriele | 16/386 |
| 5,127,132 | 7/1992 | Karlin | 16/261 |

FOREIGN PATENT DOCUMENTS

| | | | |
|---|---|---|---|
| 3513577 | 10/1986 | Germany | 16/260 |

*Primary Examiner*—M. Rachuba
*Assistant Examiner*—Donald M. Gurley
*Attorney, Agent, or Firm*—Walter A. Hackler

[57] ABSTRACT

A hinged platform assembly includes a platform having an end member with a lobed surface on one side thereof and a relatively flat surface on another side thereof. A socket assembly is provided for receiving the end member and enabling the member to turn about an axis within said socket means. The socket assembly includes an opening therein for enabling insertion of the member into said socket means at one angular relationship between said member and the socket assembly and preventing separation of the member and the socket assembly at all other angular relationships therebetween. The socket assembly further includes opposing surfaces for preventing turning of the member within the socket assembly past a selected angle therebetween, thus allowing the platform to support heavy loads without the need of additional components or struts of any kind.

7 Claims, 5 Drawing Sheets

FIG. 9.
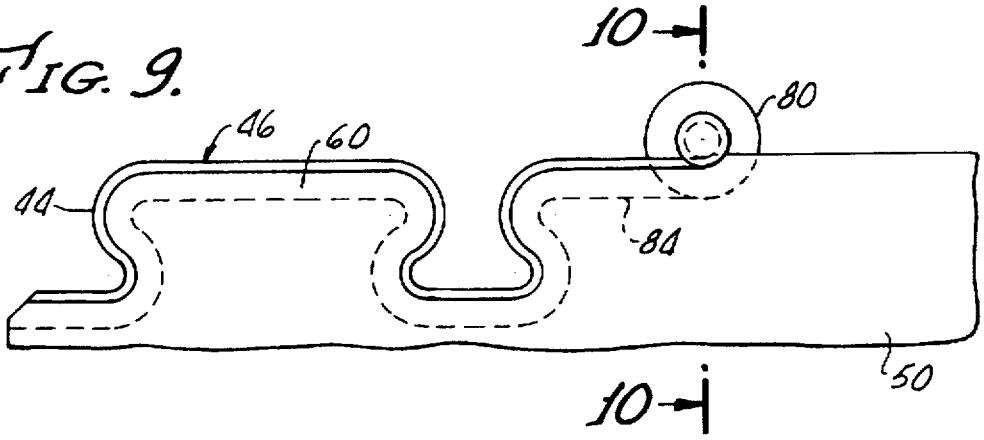
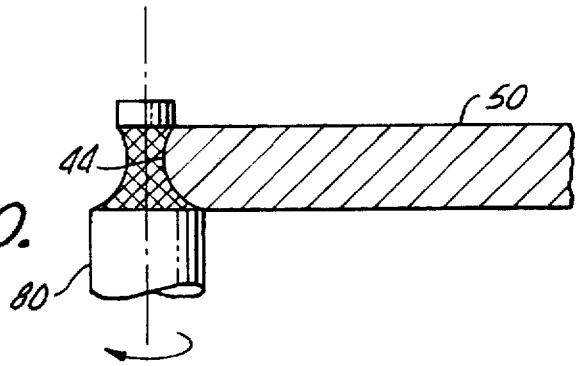
FIG. 10.
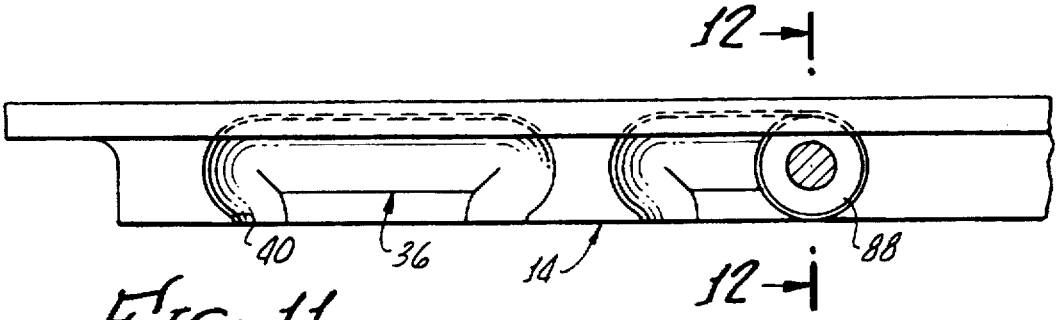
FIG. 11.
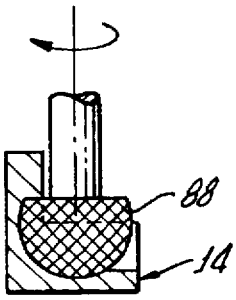
FIG. 12.

HINGE ASSEMBLY, PLATFORM AND METHOD OF MAKING SAME

The present invention generally relates to hinges and more specifically to a hinge assembly and platform suitable for use in a number of applications.

More particularly the present invention is directed to a hinge assembly which may be incorporated into a load platform and a supporting structure.

A great number of devices ranging from simple removable shelves to heavy duty work platforms require the use of a simple, durable hinge structure having minimal parts which is easy to fabricate.

Many hinge assemblies include nondetachable members which provide articulated movement between a structure and a shelf, or load platform. However, in situations where the platform is to be easily removed from the structure, said hinge mechanisms are not appropriate.

A further requirement for most shelves and work platforms is maintenance of a stable or rigid position of the work platform relative to the attached structure when the platform is pivoted about a hinge assembly when in a use position.

While heretofore hinge assemblies enabled the detachable yet rotatable, or pivotable, movement of a work platform with respect to a support structure, these prior art hinges do not provide a locked position of the platform with respect to the structure to enable the platform to sustain heavy loads without other support.

The present invention provides for an easily manufactured hinge assembly and platform which enables the detachable mounting of a platform to a structure, hinged rotation of the platform with respect to the structure, and support of the platform in an extended position, with respect to the structure, capable of bearing significant loads. Further, the present invention features a minimal number of parts, namely, two.

SUMMARY OF THE INVENTION

The hinge assembly in accordance with the present invention generally includes a member having a lobed surface on one side thereof and a relatively flat surface on another side thereof. A socket provides means for receiving the member and enabling the member to turn on an axis within the socket. The socket generally includes means defining an opening in the socket for enabling insertion of the member into the socket at one angular relationship between the member and the socket, and preventing the separation of the member and the socket at other angular relationships therebetween.

The socket further includes means defining opposing surfaces thereof for preventing turning of the member within the socket past a selected angle therebetween.

When incorporated into a platform, an assembly is provided in which the platform includes an end with a lobed surface thereof and a relatively flat surface on another side thereof. In this embodiment, the platform is capable of supporting a load when opposing surfaces of the socket engage opposite sides of the platform end.

More particularly, in accordance with the present invention, the member may include two lobed surfaces on different sides of the member, and the socket may include two cavities for receiving the two lobed surfaces. In a preferred embodiment of the present invention, the two lobed surfaces are disposed on opposite sides of the member.

Each of the cavities include spherical surfaces, and the opposing surfaces of the socket are disposed in an orientation causing the selected angle to be 90° from a one angular relationship enabling insertion of the member into the socket.

More particularly, the member may include a plurality of ears, with each ear having two lobes on different sides of each ear, and the socket includes a plurality of cavities, each sized and disposed for receiving one of the lobed surfaces. Specifically, each of the lobed surfaces may be approximately quarterspherical and the cavities may be hemispherical.

The present invention also encompasses a method of making the hinge assembly which includes the steps of continuously cutting lobed surfaces on one end of a first member using a cutter have a concave profile and continuously cutting sockets in another member, with a convex cutter, the sockets being sized for receiving the cut lobed surfaces.

BRIEF DESCRIPTION OF THE DRAWINGS

The advantages and features of the present invention will be better understood by the following description when considered in conjunction with the accompanying drawings in which:

FIG. 9 is a plan view of a member showing fabrication of a male portion of the present invention via continuous machining with a cutter;

FIG. 10 is a cross sectional view, taken along the line 10—10 of FIG. 9 illustrating the fabrication of the male portion by the cutter;

FIG. 11 is a plan view of a member showing fabrication of a female portion of the present invention via continuous machining with a cutter; and FIG. 12 is a cross sectional view, taken along the line 12—12 of FIG. 11 illustrating the fabrication of the female portion by the cutter.

DETAILED DESCRIPTION

Figure 1:
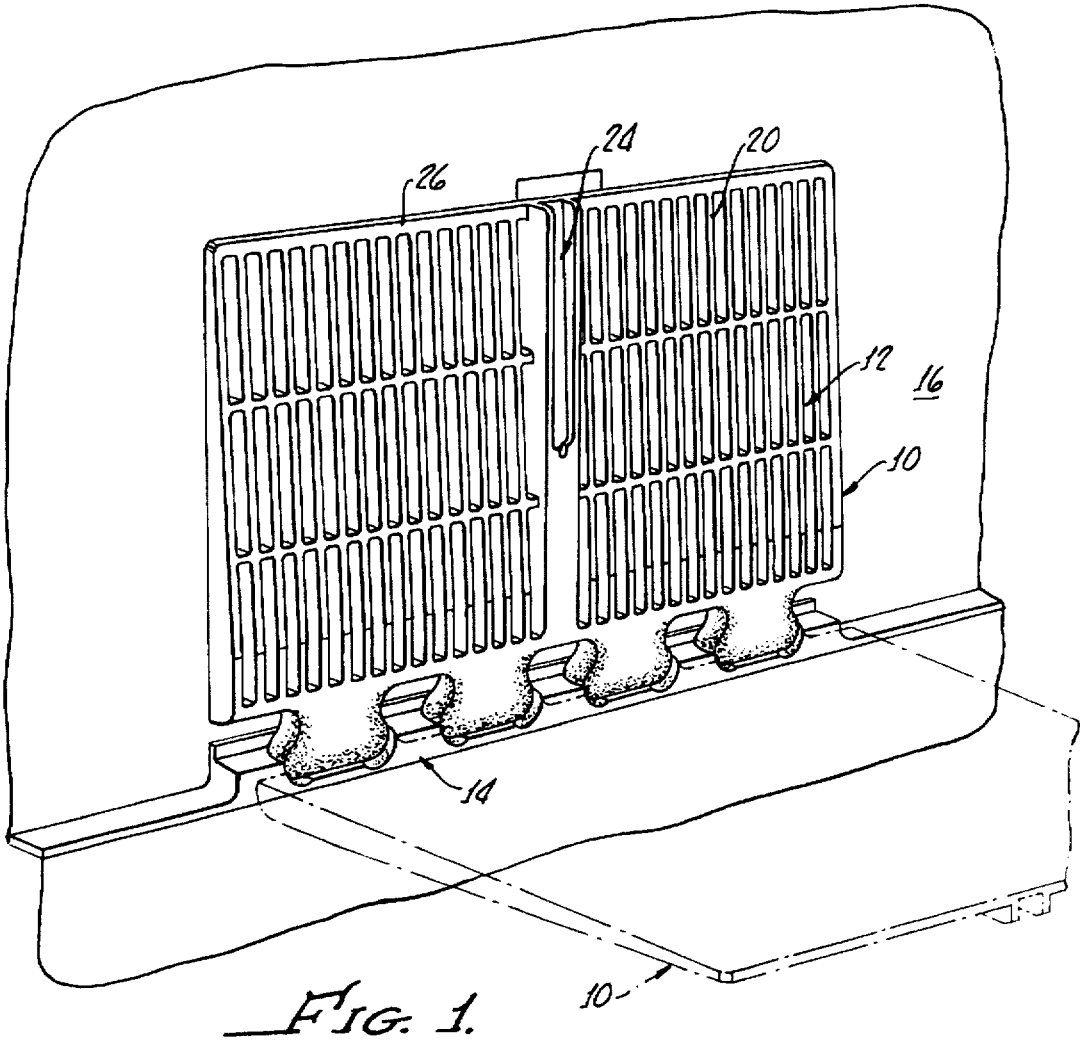
FIG. 1 shows in perspective the hinged assembly and platform in accordance with the present invention as it may be attached to a structure, the drawing showing the platform in a folded configuration, solid lines, and in an extended, or down, position, phantom lines.

A hinge/platform assembly 10 generally includes a member, or platform, 12 and a socket arrangement 14 which enables pivotal coupling of the platform to a support structure 16, which may be any suitable stationary or mobile structure from which the platform, or shelf, 12 may be used in combination. As hereinafter described, the hinge/platform assembly 10 is removable from the support structure 16 and when extended therefrom, as hereinafter shown, can support sizeable load. Depending upon its use, this load may include that of personnel who may use the platform 12 as a step or work platform. Alternatively, the platform in the extended position may be configured by way of material construction for supporting minor loads.

In that regard, the platform 12 may be formed from any suitable material depending upon load requirements and may include ribs 20 for providing integral strength to the platform. If the hinge/platform is utilized on a portable or moveable work station, a swing-out down post 24 may be provided to prevent tipping of the work station, not shown.

The socket assembly 14 and the platform may be constructed in any manner such as casting or machining, all of which may be suitable for specific applications.

Figure 2:
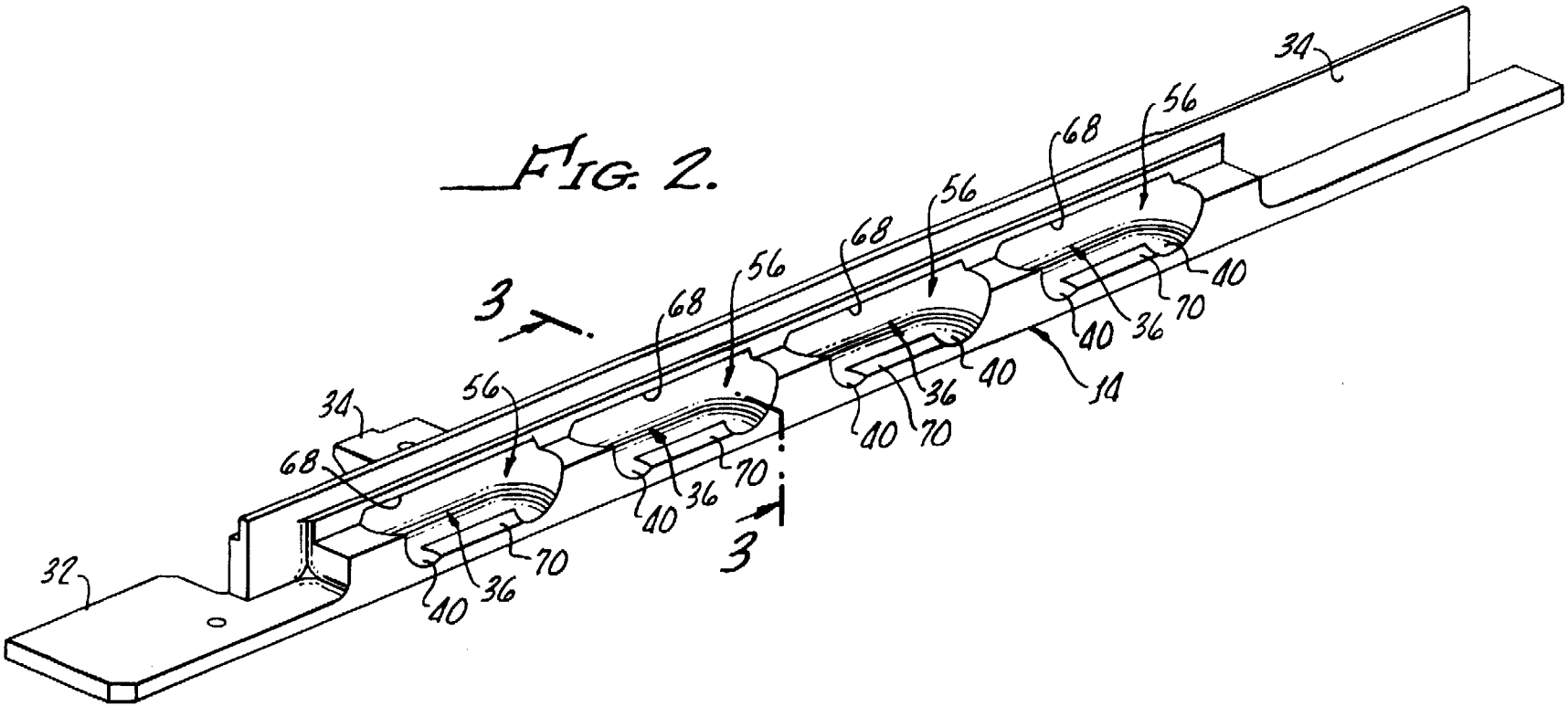
FIG. 2 is a perspective view of a socket assembly in accordance with the present invention as it may be incorporated into the support structure.

Turning now to FIG. 2, there is shown in perspective, a socket assembly 14, in accordance with the present invention, which may be machined, as hereinabove noted, or cast from suitable plastic or metal stock which includes mounting tabs 32, 34 for securing the socket assembly 14 to the structure 16.

Figure 3:
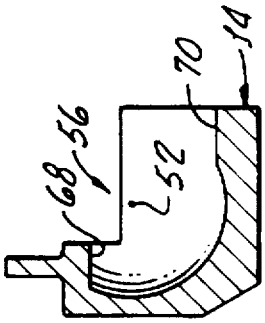
FIG. 3 is a cross-sectional view of one of the sockets shown in FIG. 2 taken along the line 3—3.
Figure 5:
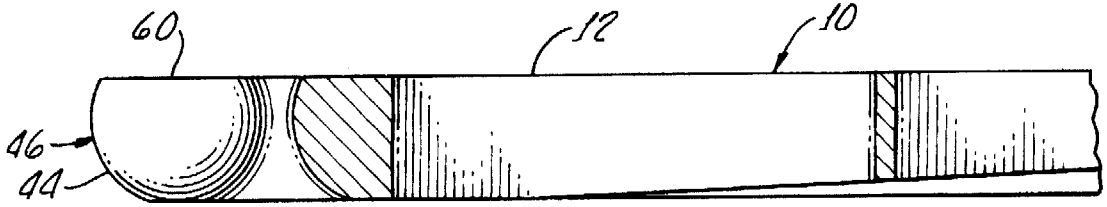
FIG. 5 is a cross-sectional view of an ear taken along the line 5—5 in FIG. 4.
Figure 4:
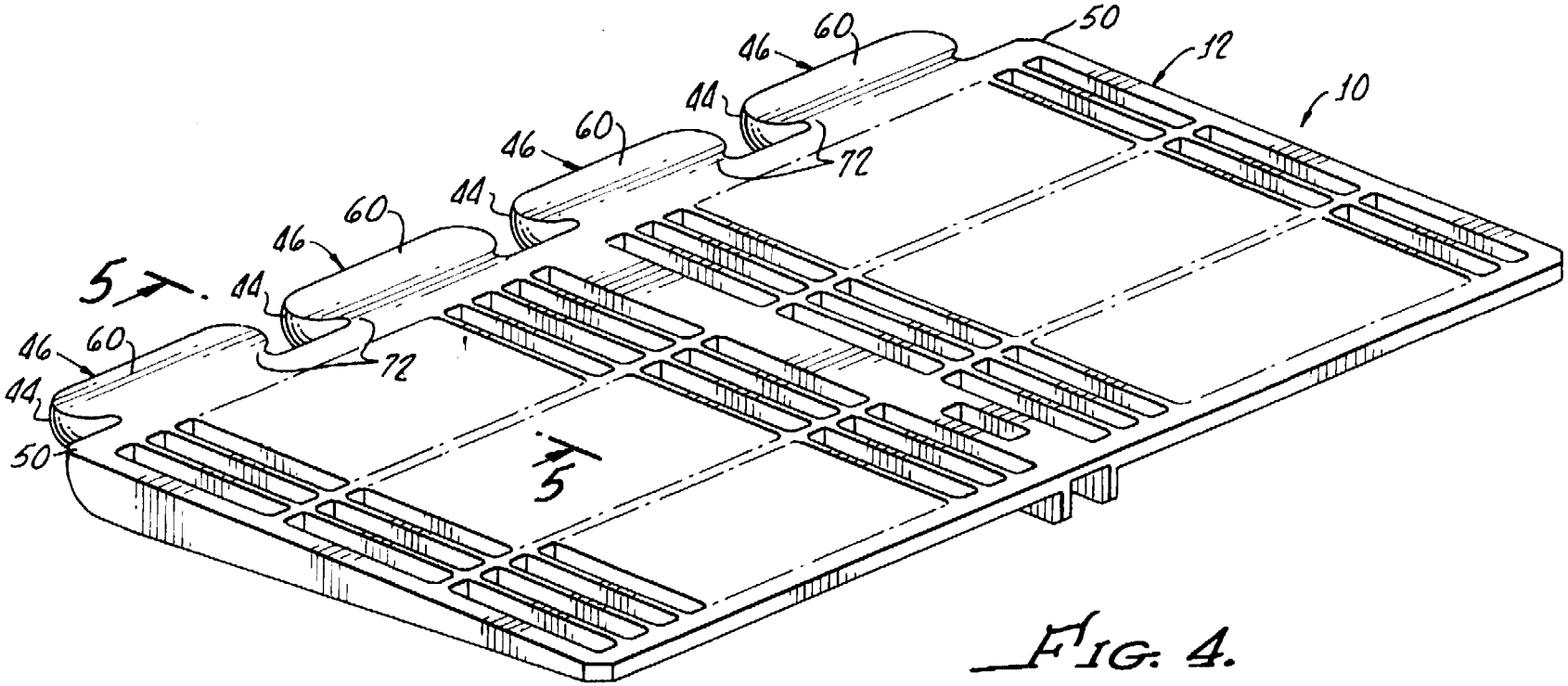
FIG. 4 is a perspective view of a platform including ears with lobed surfaces thereon, sized for insertion into the sockets shown in FIG. 2.

The socket assembly 14 may include a plurality of sockets 36, each having generally spherical cavities 40 for receiving opposing ends 44 of ears 46 extending from an end 50 of the platform 12 (see FIG. 4). The sockets 36 provide a means for receiving the end 50 of the platform 12 and enabling the platform 12 to turn about an axis within the sockets 36 (see FIG. 3).

Figure 6:
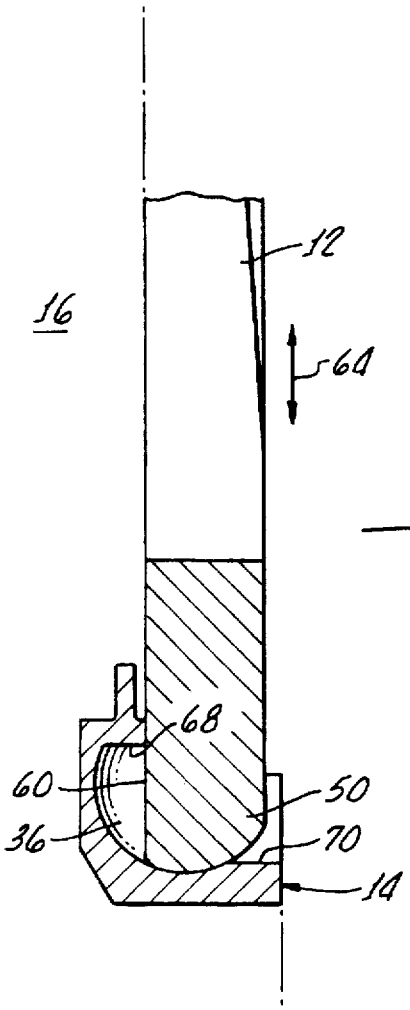
FIG. 6 is a cross-sectional view of the present invention shown in a folded configuration enabling removal of the platform from the socket.

As also shown in FIGS. 2 and 3, the sockets 36 include openings 56 which enable insertion of the ears 46 thereinto, as shown in FIG. 6. The flat surface 60 on end 50 of the platform 12 and ears 46 enable vertical insertion and removal of the panel 12 into the socket 36, as indicated by the arrow 64.

Once inserted, the lobed ends 44 prevent reseparation of the platform from the socket assembly 14 and support structure 16 at any other angle other than as shown in FIG. 6, in which the platform 12 and support structure 16 are generally parallel with one another.

Figure 7:
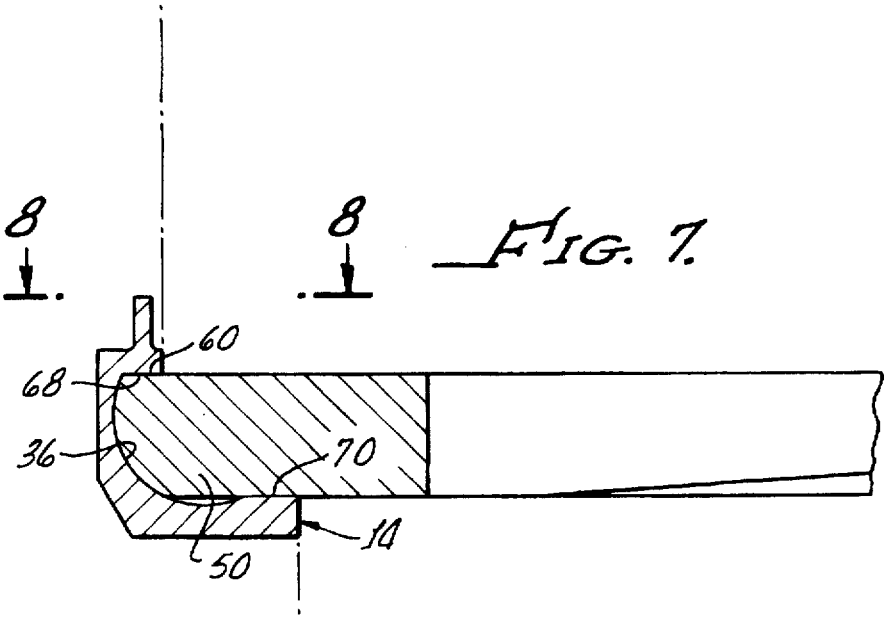
FIG. 7 is another cross-sectional view of the present invention showing the socket with the platform in an extended position suitable for loading.

The socket assembly 14 further includes opposing surfaces 68, 70 which provide a means for preventing turning of the platform 12 within the socket assembly 14 past a selected angle therebetween. As shown in FIG. 7, this angle may be approximately 90° from the position of the platform 12, as shown in FIG. 6, i.e., the horizontal position. However, a wide range of angles can be easily accommodated.

Figure 8:
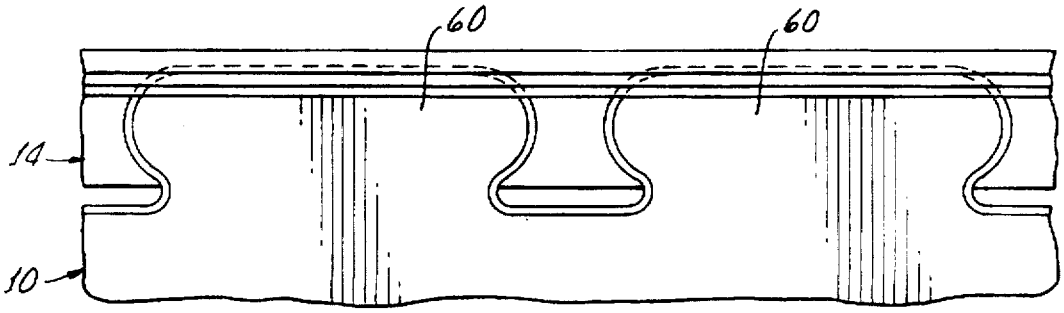
FIG. 8 is a partial top view of the socket and platform taken along the line 8—8 of FIG. 7.

Opposing surfaces 68, 70 not only prevent movement of the platform past a 90° relationship with the structure 16 but also enable a significant load to be placed on the platform without additional support thereof. The position of the platform 12 in FIG. 7 is shown in a cutaway top view in FIG. 8 where it shows the ends 44 extending from ears 46 with a neck 72 interconnecting the ears 46 with the end 50 of the platform 12. As shown, a portion 76 of the ears 46 is disposed beneath the opposing surface 68 of the socket assembly 14.

As previously stated, the two hinge components, ie the socket assembly, or female portion, 14 and lobed ends, male portion, 44 may be economically produced by machining. FIGS. 9 and 10 illustrate fabrication of the male portion 44 in accordance with the present invention by continuous machining with a cutter 80. Cutting surfaces 82 on the cutter 80 are selected to provide the desired curvature of the male portion 44.

The simple form cutter 80 enables the male hinge portion 44 to be generated in a single pass following the cutter path 84 as shown in FIG. 9. An NC mill, a tracer mill, or even a hand router and template may be used.

The socket assembly, ie female portion, 14 of the hinge is essentially the negative of the male portion 44, and is fabricated, using the same methods as hereinabove described, with a form cutter 88 as shown in FIGS. 11 and 12.

Although there has been hereinabove described a hinge assembly and platform in accordance with the present invention, for the purpose of illustrating the manner in which the invention may be used to advantage, it should be appreciated that the invention is not limited thereto. Accordingly, any and all modifications, variations, or equivalent arrangements which may occur to those skilled in the art, should be considered to be within the scope of the present invention as defined in the appended claims.

What is claimed is:

1. A hinged platform assembly comprising:

a platform having an end member with a lobed surface on one side thereof and a relatively flat surface on another side thereof;

socket means for receiving said end member and enabling the end member to turn about an axis within said socket means, said socket means including means, defining an opening in said socket means, for enabling insertion of the end member into said socket means at one angular relationship therebetween, contacting and supporting of the end member and platform at said one angular relationship and preventing separation of said end member and said socket means at all other angular relationship therebetween, said socket means further including means, defining opposing surfaces of said socket means, for cantilevering said platform, by way of said end member, at approximately a 90° angle from said one angular relationship.

2. The hinged platform assembly according to claim 1 wherein said member includes two lobed surfaces on different sides of said member and said socket means includes two cavities for receiving the two lobed surfaces.

3. The hinged platform assembly according to claim 2 wherein the two lobed surfaces are disposed on opposing sides of said member.

4. The hinged platform assembly according to claim 3 wherein each of the two lobed surfaces and two cavities includes spherical surfaces.

5. The hinged platform assembly according to claim 1 wherein said member comprises a plurality of ears, each ear having two lobed surfaces on different sides of each ear, and said socket means includes a plurality of cavities, each sized and disposed for receiving one of the lobed surfaces.

6. The hinged platform assembly according to claim 5 wherein each of the lobed surfaces is generally quarterspherical, and said cavities are generally hemispherical.

7. The hinged platform assembly according to claim 6 wherein each of the two lobed surfaces on each ear extend outwardly from a neck portion of each ear.

* * * * *